US009446324B2

(12) United States Patent
Barthold et al.

(10) Patent No.: US 9,446,324 B2
(45) Date of Patent: Sep. 20, 2016

(54) METHOD AND APPARATUS FOR LAUNCHING ACTION FIGURES

(71) Applicant: Mattel, Inc., El Segundo, CA (US)

(72) Inventors: Mark Barthold, Santa Monica, CA (US); Michael Strauss, Signal Hill, CA (US)

(73) Assignee: Mattel, Inc., El Segundo, CA (US)

( * ) Notice: Subject to any disclaimer, the term of this patent is extended or adjusted under 35 U.S.C. 154(b) by 205 days.

(21) Appl. No.: 13/774,580

(22) Filed: Feb. 22, 2013

(65) Prior Publication Data

US 2014/0073218 A1 Mar. 13, 2014

Related U.S. Application Data

(60) Provisional application No. 61/602,908, filed on Feb. 24, 2012.

(51) Int. Cl.
*A63H 11/06* (2006.01)
*A63H 7/00* (2006.01)

(52) U.S. Cl.
CPC ..... *A63H 7/00* (2013.01)

(58) Field of Classification Search
CPC ..... A63H 13/12; A63H 7/00
USPC ..... 446/268, 308, 309
See application file for complete search history.

(56) References Cited

U.S. PATENT DOCUMENTS 732,281 A * 6/1903 Durboraw ..... 273/355
1,075,865 A * 10/1913 Sharp ..... 273/343
1,178,028 A 4/1916 Schlueter
1,374,420 A 4/1921 Berggreen
1,400,097 A 12/1921 Perkins
1,542,063 A * 6/1925 Knight ..... 273/399
1,576,515 A * 3/1926 Kinney ..... 273/399
2,012,424 A 8/1935 Fincke
2,151,546 A 3/1939 Arnold
2,518,913 A 8/1950 Levi
2,638,708 A 5/1953 Grow
2,799,501 A 7/1957 Barbolla
2,911,758 A 11/1959 Carson
2,949,694 A 8/1960 Aye
2,974,954 A 3/1961 Martin
3,074,720 A 1/1963 Carver et al.
3,425,153 A 2/1969 Bonanno et al.
3,445,114 A * 5/1969 Fernandez ..... 273/348.3
3,565,432 A * 2/1971 Reiner et al. ..... 273/412
3,600,849 A 8/1971 Faller
3,693,288 A * 9/1972 Lewis et al. ..... 446/330
3,715,121 A * 2/1973 Renn ..... 273/405
3,724,855 A * 4/1973 Chu ..... 273/317.3
3,789,542 A 2/1974 Sims et al.

(Continued)

*Primary Examiner* — Melba Bumgarner
*Assistant Examiner* — Joseph B Baldori
(74) *Attorney, Agent, or Firm* — Edell, Shapiro & Finnan, LLC

(57) ABSTRACT

A launching device for grasping and launching an action figure is provided, the launching device having: a base member; an arm member pivotally secured to the base member for movement between a first position and a second position; a pair of grasping members rotatably secured to the arm member, wherein the pair of arm members are configured to releasably grasp a portion of the action figure; a drivetrain coupled to the pair of grasping members wherein the drivetrain is configured to rotate the pair of grasping members about an axis of the arm member as the arm member moves between the first position and the second position.

17 Claims, 8 Drawing Sheets

(56) References Cited

U.S. PATENT DOCUMENTS 3,794,325 A * 2/1974 Stender ..... 273/399
3,839,820 A * 10/1974 Serman, Jr. ..... 446/309
3,856,304 A * 12/1974 Matsumoto et al. ..... 273/440.1
3,901,208 A 8/1975 Laporte et al.
3,927,883 A * 12/1975 Bosley et al. ..... 273/440.1
4,047,325 A 9/1977 Yamazaki
4,091,563 A * 5/1978 Noble et al. ..... 273/440.1
4,111,179 A * 9/1978 Hashimoto ..... 124/7
4,120,117 A 10/1978 Terzian et al.
4,155,552 A 5/1979 Jacobo et al.
4,186,517 A * 2/1980 Kuhn et al. ..... 446/330
4,233,952 A 11/1980 Perkins
4,244,138 A * 1/1981 Holahan et al. ..... 446/301
4,253,669 A * 3/1981 Ferris et al. ..... 273/368
4,655,725 A 4/1987 Torres
4,659,320 A * 4/1987 Rich et al. ..... 446/435
4,689,034 A * 8/1987 Dubois et al. ..... 446/309
4,985,008 A 1/1991 Price
5,009,424 A * 4/1991 Harth et al. ..... 273/440.1
5,042,807 A * 8/1991 Sasakawa et al. ..... 273/440.1
5,150,898 A * 9/1992 Hochberg et al. ..... 273/317.3
5,181,500 A 1/1993 Chamberland
5,282,634 A 2/1994 Chamberland
5,288,071 A * 2/1994 Solomon ..... 273/317.3
5,344,156 A * 9/1994 Levin ..... 273/355
5,352,148 A 10/1994 Watkins
5,392,755 A 2/1995 Sutton
5,397,260 A * 3/1995 Tilbor et al. ..... 446/4
5,403,225 A 4/1995 Watkins
5,435,570 A * 7/1995 Labrasseur ..... 273/355
5,458,523 A * 10/1995 Aoki et al. ..... 446/246
5,478,269 A * 12/1995 Wolfram ..... 446/330
5,556,319 A 9/1996 Watkins
5,690,330 A * 11/1997 Ozawa ..... 273/108.56
5,788,242 A * 8/1998 Rudell et al. ..... 273/317.3
5,823,850 A 10/1998 Watkins
5,851,012 A * 12/1998 Langieri et al. ..... 273/317.1
5,964,638 A * 10/1999 Emerson ..... 446/339
6,171,169 B1 1/2001 Saunders
6,325,692 B1 * 12/2001 Webb ..... 446/75
6,336,838 B1 1/2002 Levy et al.
6,537,129 B1 * 3/2003 Kane ..... 446/323
6,837,769 B1 * 1/2005 Skov et al. ..... 446/139
6,851,951 B2 * 2/2005 Choi et al. ..... 434/262
6,860,787 B1 * 3/2005 Woodhouse ..... 446/268
6,889,678 B1 * 5/2005 Oltmann ..... 124/7
7,032,583 B1 4/2006 Hall
7,415,976 B1 * 8/2008 Powell ..... 124/16
7,475,881 B2 * 1/2009 Blagg et al. ..... 273/440.1
7,591,471 B2 * 9/2009 Walterscheid ..... 273/348.3
7,857,679 B2 12/2010 O'Connor et al.
7,895,995 B2 * 3/2011 Simon ..... 124/5
7,900,617 B1 * 3/2011 Kersh ..... 124/5
8,128,092 B2 * 3/2012 Ritter ..... 273/292
8,181,964 B2 * 5/2012 Ritter et al. ..... 273/445
2006/0292958 A1 12/2006 Sun et al.
2007/0141948 A1 * 6/2007 Nakazato et al. ..... 446/330
2008/0268743 A1 10/2008 O'Connor et al.
2010/0041305 A1 2/2010 O'Connor
2010/0159800 A1 6/2010 O'Connor
2010/0181720 A1 * 7/2010 Barthold et al. ..... 273/242
2010/0273394 A1 10/2010 O'Connor et al.
2010/0291833 A1 11/2010 O'Connor et al.
2010/0304637 A1 * 12/2010 Bullock ..... 446/310
2011/0074105 A1 * 3/2011 Ferron ..... 273/236
2011/0092132 A1 4/2011 O'Connor et al.
2011/0124265 A1 5/2011 O'Connor et al.
2011/0269369 A1 11/2011 O'Connor et al.
2012/0048251 A1 * 3/2012 Oblack et al. ..... 124/5
2012/0161397 A1 * 6/2012 Moran et al. ..... 273/359

* cited by examiner

METHOD AND APPARATUS FOR LAUNCHING ACTION FIGURES

CROSS REFERENCE TO RELATED APPLICATIONS

This application claims the benefit of U.S. Provisional patent application Ser. No. 61/602,908, filed Feb. 24, 2012, the contents of which are incorporated herein by reference thereto.

BACKGROUND

Various embodiments of the present invention are related to an apparatus and method for launching action figures.

Children's toys have included miniature cars, boats, trains, figures, etc. wherein the user's imagination provides for hours of extended play and enjoyment. Toy figures that resemble fighting or combat type activities are particularly popular as the user can participate in imaginary battles and/or scenes.

Accordingly, it is desirable to provide a toy that resembles combat activities and allows for interaction with the user.

SUMMARY OF THE INVENTION

In one embodiment, a launching device for grasping and launching an action figure is provided, the launching device having: a base member; an arm member pivotally secured to the base member for movement between a first position and a second position; a pair of grasping members rotatably secured to the arm member, wherein the pair of arm members are configured to releasably grasp a portion of the action figure; a drivetrain coupled to the pair of grasping members wherein the drivetrain is configured to rotate the pair of grasping members about an axis of the arm member as the arm member moves between the first position and the second position.

In another embodiment a play set is provided, the play set having: at least one action figure; a launching device for grasping and launching the action figure, the launching device comprising: a base member; an arm member pivotally secured to the base member for movement between a first position and a second position; a pair of grasping members rotatably secured to the arm member, wherein the pair of arm members are configured to releasably grasp a portion of the action figure; a drivetrain coupled to the pair of grasping members wherein the drivetrain is configured to rotate the pair of grasping members about an axis of the arm member as the arm member moves between the first position and the second position; and a target having a break away portion releasably retained therein, the break away portion being configured to be released from the target upon impact from the action figure.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

In accordance with various embodiments of the present invention an apparatus for launching an action figure is disclosed. In addition, a method for launching an action figure from a location is also disclosed herein. Referring now to the FIGS., a launching device 10 for use with a toy play set 12 is illustrated. In one non-limiting embodiment, the launching device 10 is configured to grasp and subsequently release (e.g., launch) the action FIG. 14.

Figure 1:
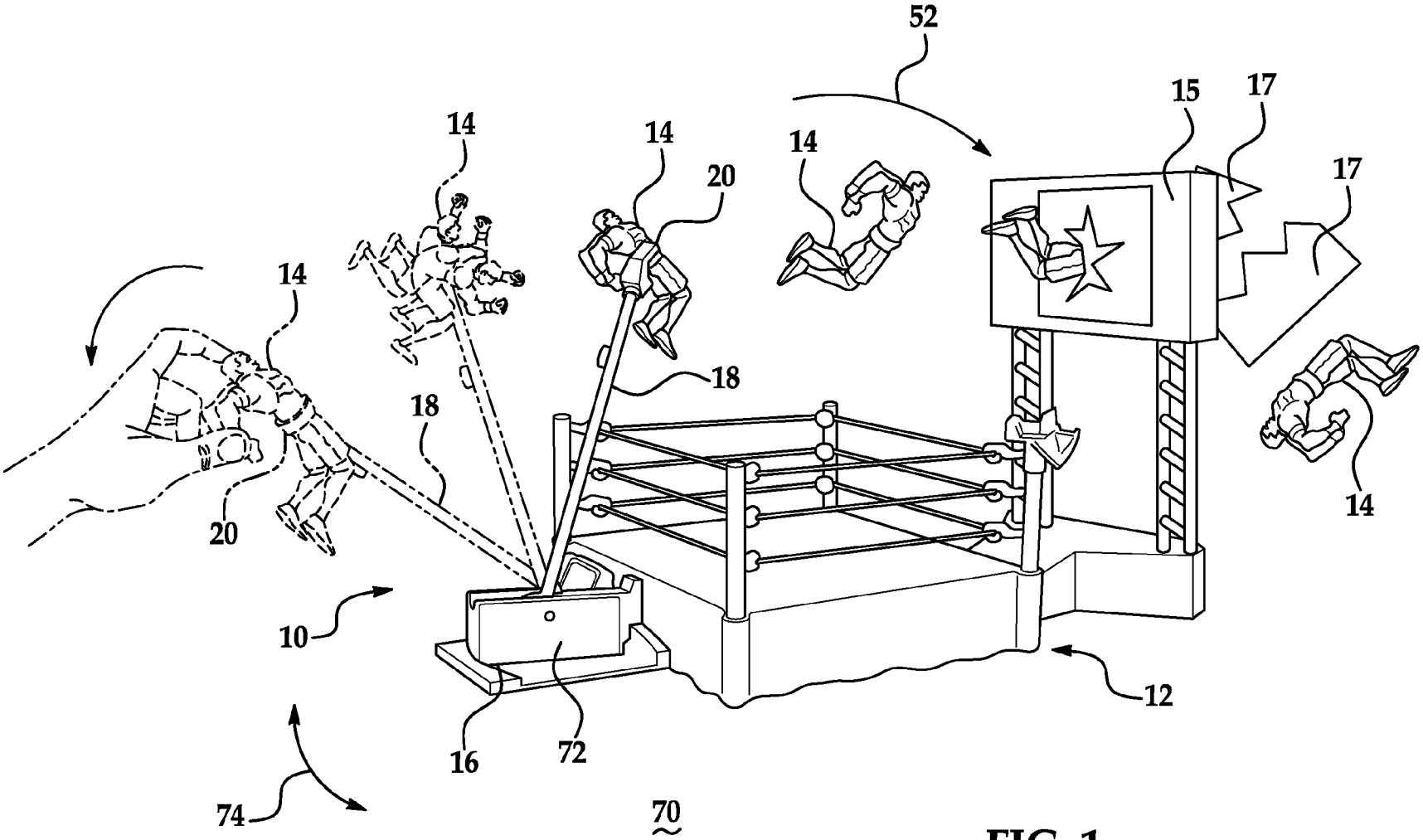
FIG. 1 is a perspective view of an embodiment of the present invention.
Figure 2:
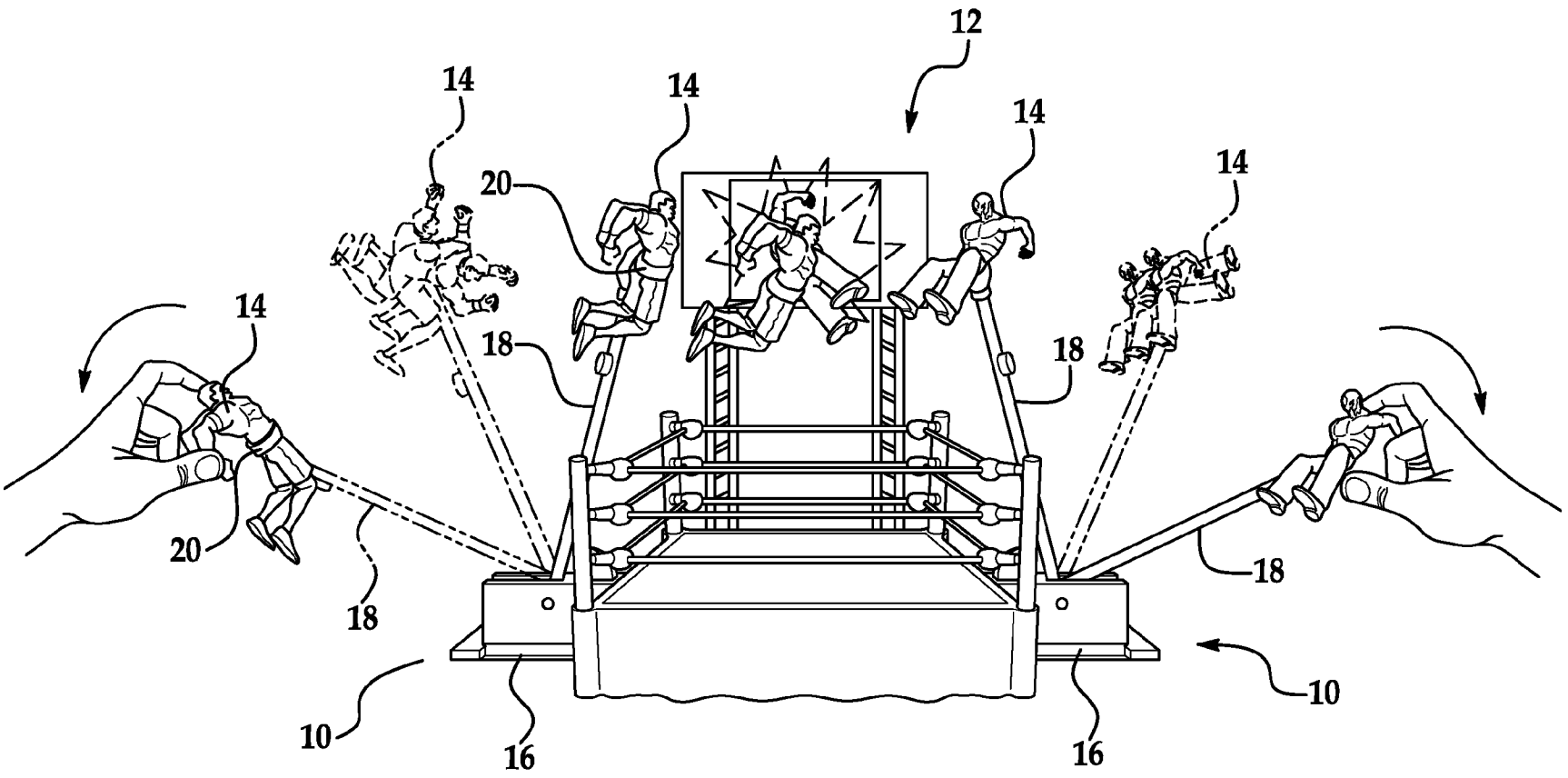
FIG. 2 is a view of an embodiment of the present invention.

The launching device 10 has a base member 16 and an arm member 18 pivotally secured to the base member 16 for movement between a first position (See at least FIGS. 3A, 5A and 6A) and a second position (See at least FIGS. 3C, 5C and 6C) wherein the action FIG. 14 is first grasped by the launching device 10 and then subsequently released (e.g., launched) by the launching device 10. FIGS. 1 and 2 also illustrate the sequential movement of the launching device 10 from the first position to the second position.

Moreover and in one embodiment the launching device 10 is configured for use with a play set 12, one non-limiting example of such a play set is the ring illustrated in at least FIGS. 1, 2 and 6A-6C. Still further and as illustrated in at least FIG. 2, the play set 12 is configured for use with a pair of launching devices 10 such that users of the play set 12 can launch the action FIG. 14 at each other, wherein they collide above the ring in the air. In yet another alternative, the play set is provided with a structure or target 15 that has breakaway portions 17 releasably secured thereto and/or each other such that if an action FIG. 14 is launched at the target 15 and makes contact with the breakaway portions 17 they are dislodged therefrom. An example of this is illustrated in at least FIG. 1. This feature adds additional play aspects wherein a user can launch the action FIG. 14 at the target 15 and cause the breakaway portions 17 to be released therefrom. In one embodiment, target 15 may resemble a portion of a wrestling ring such as, a large video screen.

The arm member 18 of the launching device 10 is pivotally secured to the base member 16 at a first end while a pair of grasping members or arm members 20 are rotatably secured to the arm member 18 at a distal opposite end of the arm member 18. In addition, the pair of grasping members or arm members 20 are configured for movement between a first closed position 22 and a second open position 24. The first closed position 22 corresponds to the arm member 18 being in the first position while the second open position 24 corresponds to the arm member being in the second position.

As the arm member 18 transitions from the first position to the second position the pair of grasping members or arm members 20 are elevated upwardly away from the launching device 10 such that the action FIG. 14 can be launched therefrom.

In one embodiment, the pair of grasping members or arm members 20 are pivotally mounted to a hub member 26 that is rotatably secured to the arm member 18. The grasping members 20 are configured to grasp a portion of the action FIG. 14 as the arm member 18 transitions from the first position to the second position. As the action FIG. 14 contained in the grasping member 20 reaches the second position, the arm member 18 comes to a sudden halt, and the forward momentum of the action FIG. 14 overcomes the grasping force of the grasping member 20, causing the action FIG. 14 to be launched in the direction of the arrow 52.

In another embodiment, the pair of grasping members or arm members 20 are pivotally mounted to a hub member 26 that is rotatably secured to the arm member 18. As illustrated in the attached FIGS., the grasping members 20 are configured to grasp a portion of the action FIG. 14 when they are in the first closed position 22 and the grasping members 20 are configured to release the portion of the action FIG. 14 when they are in the second open position 24.

In one non-limiting embodiment, the grasping members 20 are spring biased into the first closed position 22 by a spring 27 or other equivalent biasing member. The launching device 10 also has a drivetrain 30 that is coupled to the pair of grasping members 20. Drivetrain 30 is configured to rotate the pair of grasping members 20 about an axis 32 of the arm member 18 as the arm member 18 moves between the first position and the second position.

In one embodiment, the drivetrain 30 is coupled to the hub member 26 and hub member 26 is rotated by the drivetrain 30 as the arm member 18 moves between the first position and the second position. Drivetrain 30 further comprises a drive shaft 34 that is rotatably received within the arm member 18. A first end of the drive shaft 34 is coupled to the pair of grasping members 20 or alternatively hub member 26 such that as driveshaft 34 rotates with respect to the arm member 18 the pair of grasping members 20 will also rotate.

A gear member 36 is coupled to the opposite end of the driveshaft 34. Gear member 36 is configured to engage a rack 38 disposed within base member 16 of the launching device 10. In one embodiment, rack 38 has an acurate configuration such that as the arm member moves from the first position to the second position gear member 36 engages rack 38 that is fixedly secured to the base member and accordingly a rotational force in the direction of arrow 40 is provided to the driveshaft 34 as the arm member 18 transitions from the first position to the second position and gear member 36 engages rack 38.

In one embodiment and in order to transition the arm member 18 from the first position to the second position an actuating lever 42 is provided. Actuating lever 42 is pivotally mounted to the base portion 16 of the launching device 10 and is operably coupled to the arm member 18 via a linkage or any other suitable mechanism 41 operatively coupled to arm member 18 and actuating lever 42 such that movement of lever 42 causes a corresponding movement of arm member 18. In one embodiment, actuating lever 42 is configured for movement between a first position corresponding to the first position of the arm member 18 and a second position corresponding to the second position of the arm member 18. Since actuating lever 42 is operably coupled to the arm member 18 movement of the actuating lever 42 from the first position to the second position causes a corresponding movement of the arm member 18 from the first position to the second position.

Figure 4:
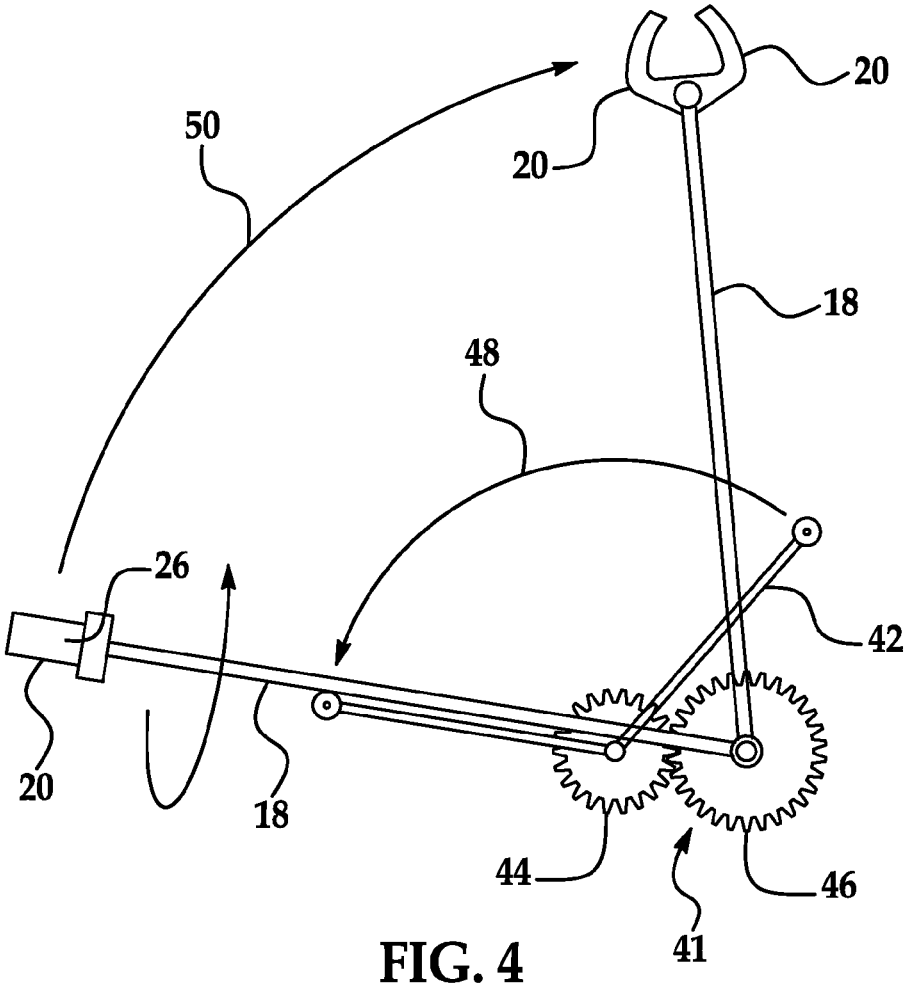
FIG. 4 is a schematic illustration of a launching device according to another embodiment of the present invention.
Figure 5A:
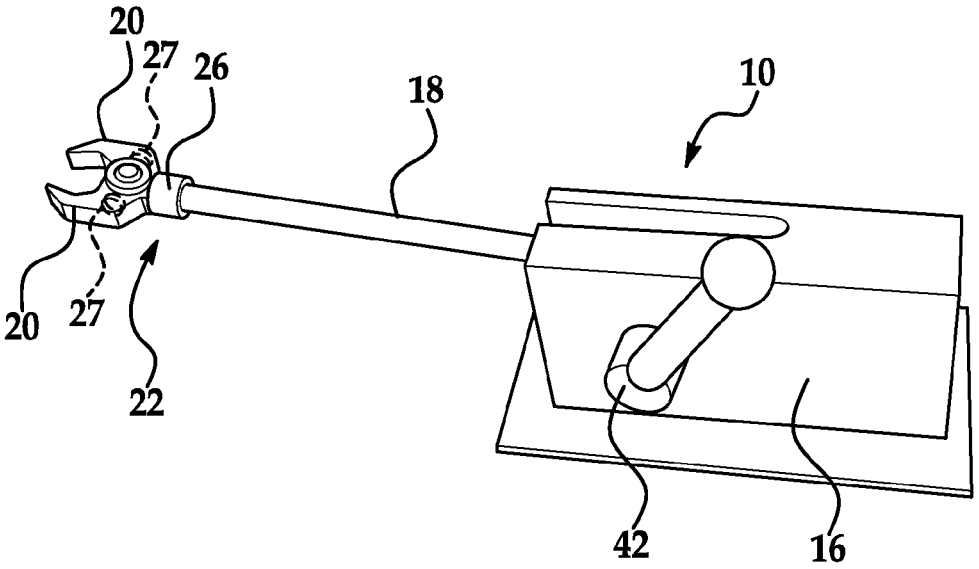
FIGS. 5A-6C are views illustrating movement of a launching device according to another embodiment of the present invention.
Figure 5B:
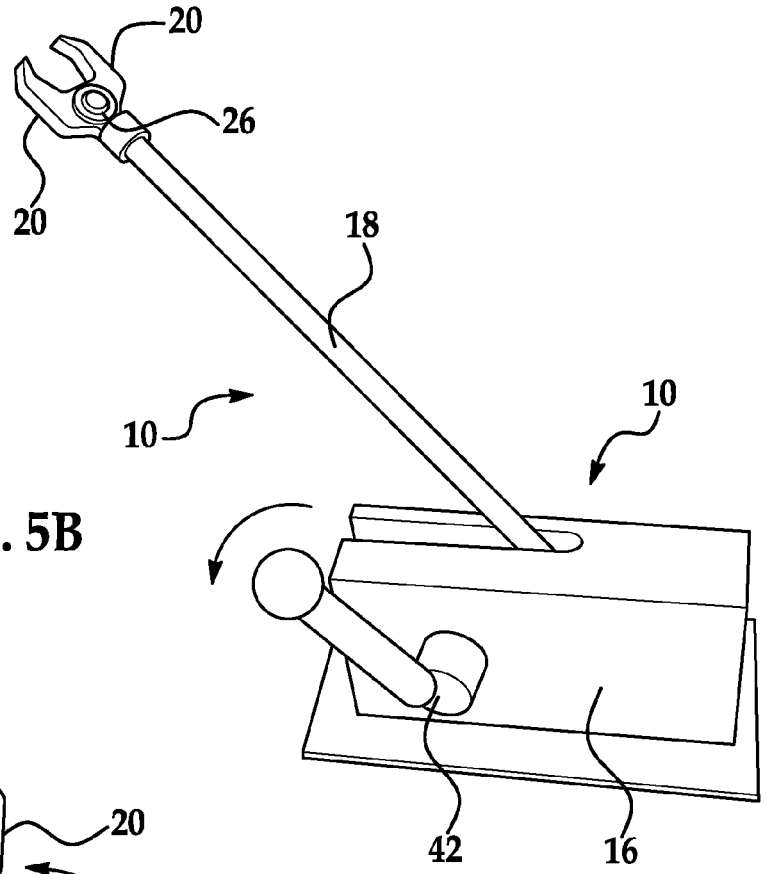
Figure 5C:
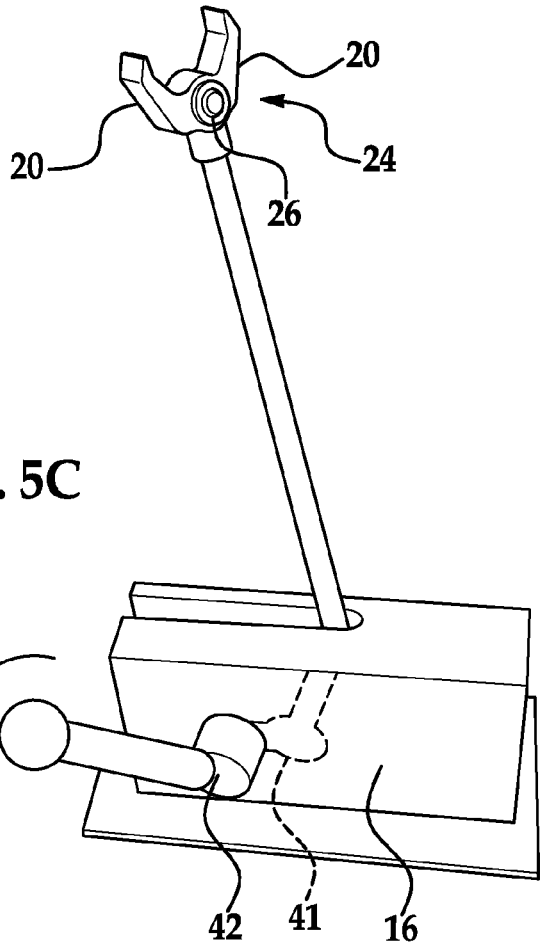
Figure 6A:
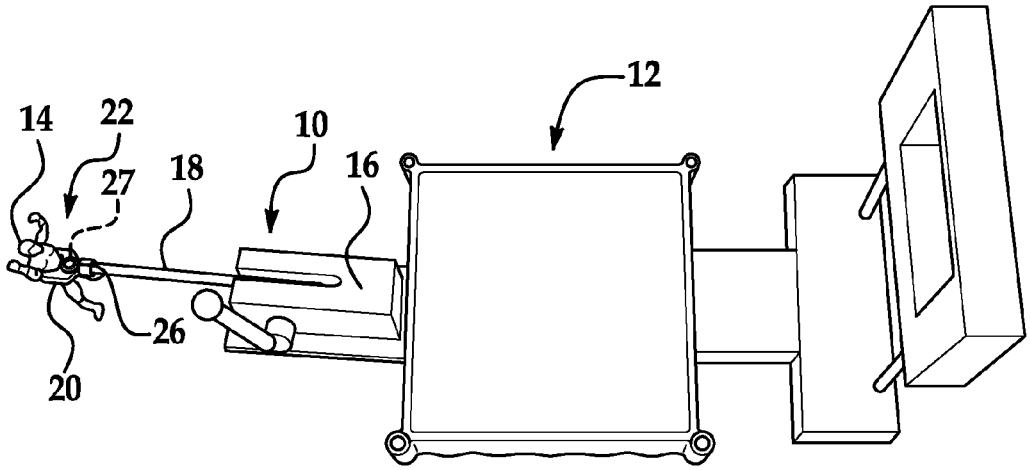
Figure 6B:
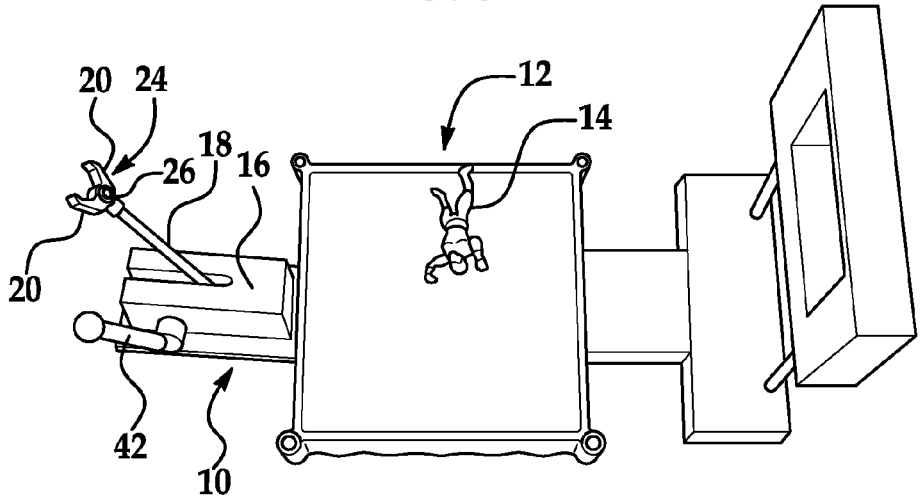
Figure 6C:
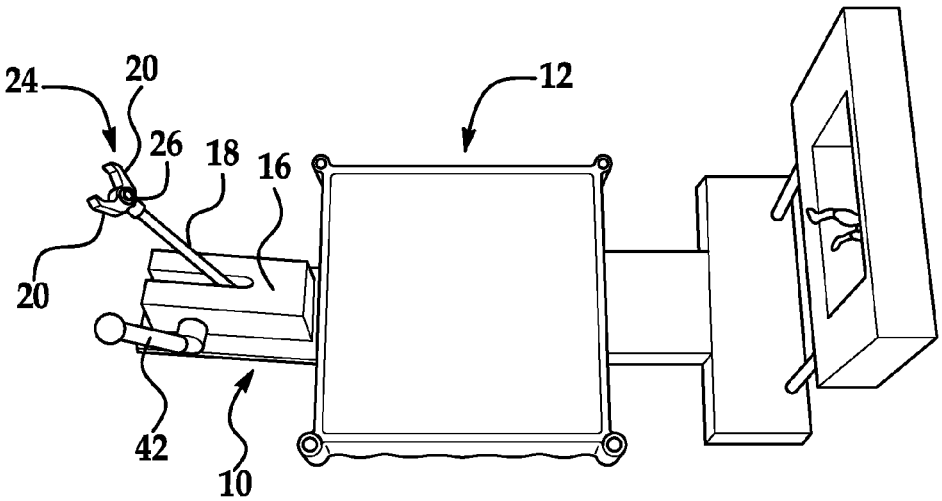

For example and as illustrated in at least FIGS. 5A-5C, actuating lever 42 is shown moving from the first position (FIG. 5A) to the second position (FIG. 5C). In one embodiment and as illustrated schematically in FIG. 4, the actuating lever 42 has or is operatively coupled to a gear portion 44 configured to engage a complementary gear portion 46 of the arm member 18 or operatively coupled thereto. Accordingly and as the actuating lever 42 moves in the direction of arrow 48, arm member 18 moves in the direction of arrow 50 due to gear portion 44 engaging gear portion 46. In addition and as mentioned above, gear member 36 of the drivetrain 30 will engage the rack 38 and thus cause rotational movement of the pair of grasping members 20 in the direction of arrow 40 as the arm member transitions from the first position to the second position. Thus, the pair of grasping members 20 rotate as the arm member 18 moves from the first position to the second position.

As mentioned above, the pair of grasping members 20 are configured to be in a first grasping position (spring biased or otherwise) wherein a portion of the action FIG. 14 is secured therein such that the action figure will be carried by the arm member 18 as it moves from the first position to the second position. Still further and as the grasping members 20 rotate, the action FIG. 14 will also rotate. Once the arm member 18 reaches its second position the grasping members 20 will transition from the first closed position to the second open position wherein the action FIG. 14 will be released and due to his momentum (e.g., movement of the arm member 18 from the first position to the second position) the action FIG. 14 will be launched in the direction of arrow 52, which in one embodiment corresponds to the direction of the arm member for movement from the first position to the second position.

Figure 7A:
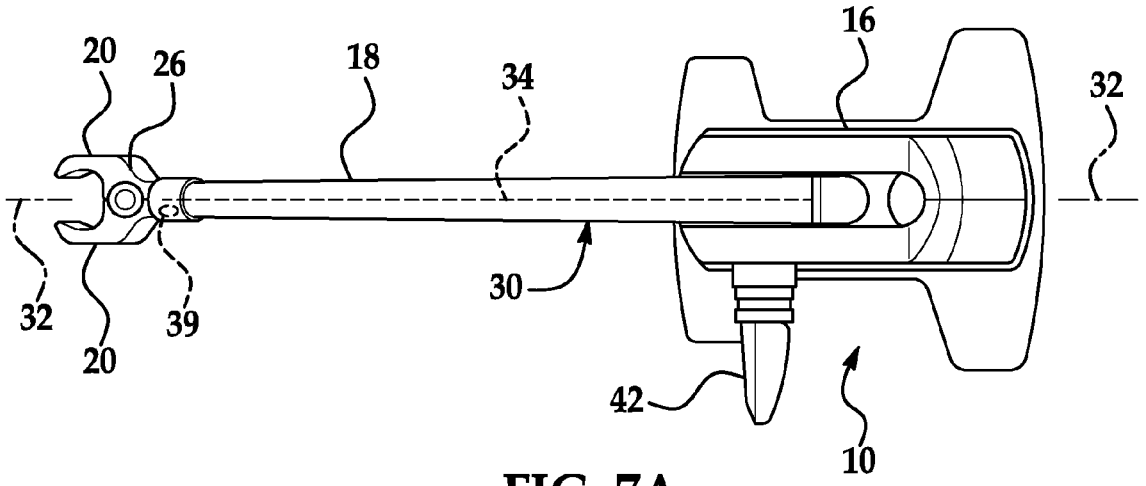
FIGS. 7A-8C are various views of a launching mechanism according to yet another embodiment of the present invention.
Figure 7B:
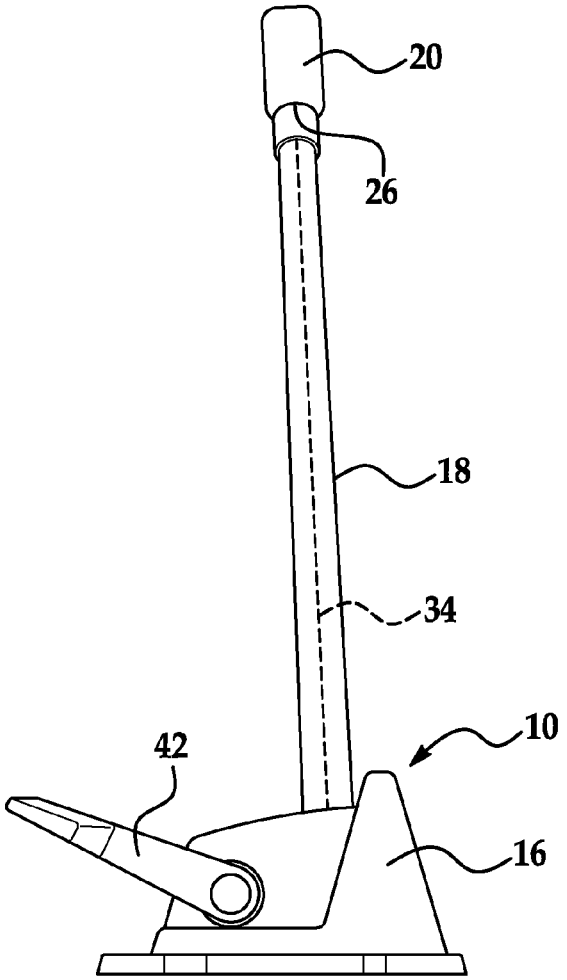
Figure 8A:
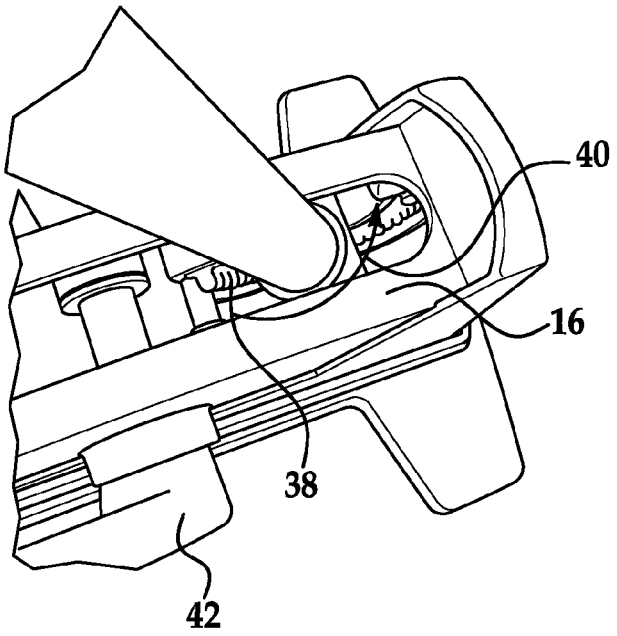
Figure 8B:
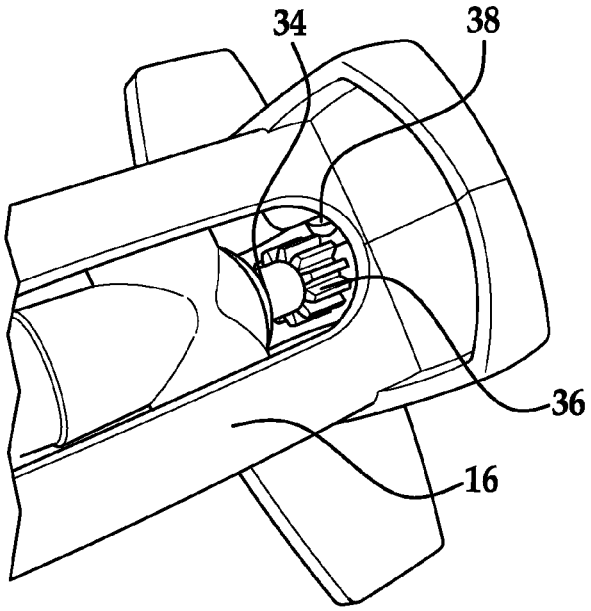
Figure 8C:
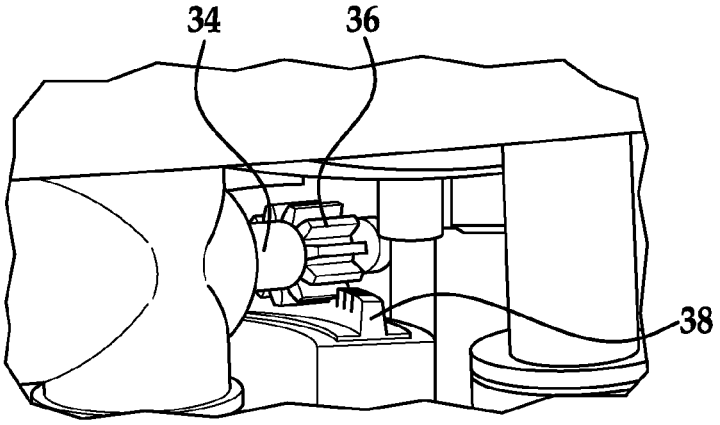

In one embodiment, the transitioning of the grasping members 20 from the first grasping position to the second open position may be simply facilitated by the momentum of the action FIG. 14 due to the abrupt stopping of the arm member 18 in the second position. Alternatively, the end portion of the driveshaft 34 coupled to the hub portion 26 and/or the grasping members 20 can be configured with a cam feature 39 (illustrated schematically in FIG. 7A) configured to engage and/or pivot the grasping members 20 from the first grasping position to the second open position as the arm member 18 transitions from the first position to the second position. For example, the driveshaft 34 can be configured to have several revolutions during the arm member's movement from the first position to the second position and when the driveshaft 34 reaches the final rotational position corresponding to the second position of the arm member, the cam feature will be positioned to engage the pair of grasping members 20 and cause them to transition to the open position such that the action FIG. 14 can be released.

As illustrated in the attached FIGS. and in one non-limiting embodiment when the arm member 18 is in the first position, the pair of grasping members 20 are parallel to a surface 70 the launching device 10 is resting upon. Accordingly, the pair of grasping members 20 are positioned to easily grasp an action FIG. 14 that is also standing or positioned upon surface 70. In another embodiment, when the arm member 18 is in the second position, the grasping members 20 are configured to be perpendicular to the direction of travel of the arm member 18, thus allowing for an unobstructed path of travel for the action FIG. 14.

In one alternative embodiment, the end portion of the arm member 18 pivotally secured to the base member 16 of the launching device 10 is pivotally secured to a wall member or portion 72 that is movably and/or pivotally secured to base member 16 such that movement in the direction of arrows 74 is possible and thus the launching device 10 may be aimed (e.g., angularly configuring wall member 72) at a target (e.g., target 15 or alternatively another action FIG. 14 being launched from another launching device 10.

Figures 3A, 3B, 3C:
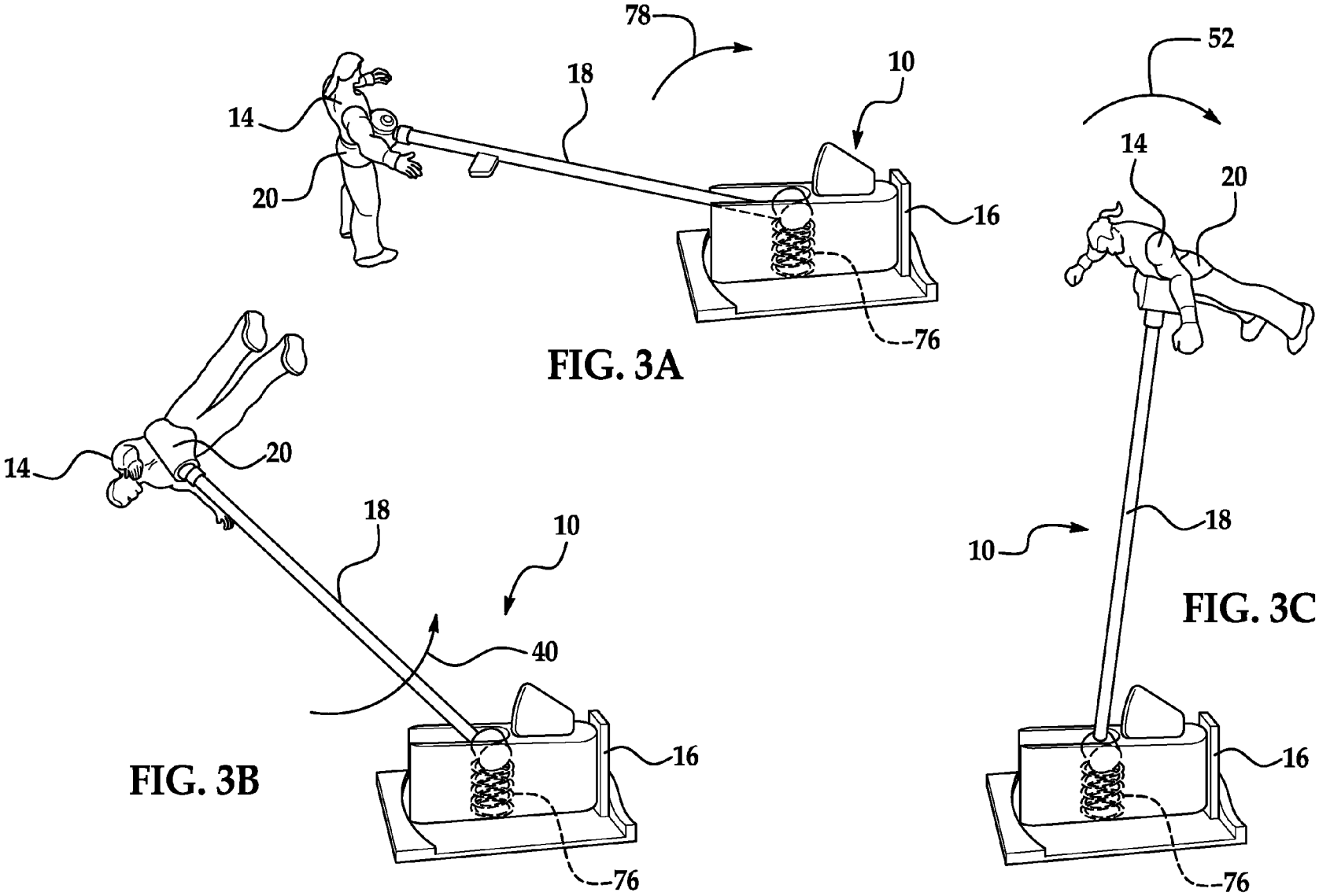
FIGS. 3A-3C are views illustrating movement of a launching device according to one exemplary embodiment of the present invention.

Referring now to FIGS. 3A-3B, yet another alternative embodiment of the present invention is illustrated. Here, the launching device 10 is configured to be spring biased into the second position (FIG. 3C) and thus a user during operation simply manipulates the arm member 18 from the second position (FIG. 3C) to the first position (FIG. 3A) thereby compressing a spring 76 that provide a biasing force in the direction of arrow 78 such that once a user's hand is removed from the arm member 18 when it is in the first position, the arm member will transition from the first position to the second position and the pair of grasping members 20 as well as the action FIG. 14 retained therein will rotate in the direction of arrow 40 and the action FIG. 14 will be released in the direction of arrow 52 once the arm member 18 reaches the second position. Accordingly and in this embodiment, the spring biasing force of spring 76 negates the need for actuating lever 42. Of course, variations and/or combinations of the various exemplary embodiments of the present invention can be combined to provide a launching device 10 that is configured to releasably grasp an action FIG. 14 and launch the same therefrom.

As illustrated and described herein, the action FIG. 14 are capable of being grasped and launched from the launching device 10 while imparting a rotational movement to the same as the arm member 18 of the launching device 10 transitions from a first position to a second position.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A launching device for grasping and launching an action figure, comprising:

a base member;

an arm member pivotally secured to the base member for movement about a pivotal axis between a first position and a second position, the arm member including a first end pivotally secured to the base, an opposite, distal end, and a longitudinal axis extending through the arm member from the first end to the distal end, the longitudinal axis being perpendicular to the pivotal axis;

a pair of grasping members rotatably secured to the arm member proximate the distal end, wherein the pair of grasping members are configured to releasably grasp a portion of the action figure in a first grasping member position; and a drivetrain coupled to the pair of grasping members wherein the drivetrain is configured to rotate the pair of grasping members about the longitudinal axis of the arm member as the arm member moves between the first position and the second position, wherein the drivetrain comprises a driveshaft rotatably received within an interior of the arm member and extending along the longitudinal axis of the arm member, and wherein movement of the arm member from the first position to the second position causes rotational movement of the driveshaft, and wherein the pair of grasping members are moved from the first grasping member position to a second grasping member position when the arm member is moved to the second position from the first position and wherein the pair of grasping members release the portion of the action figure from the pair of grasping members when the pair of grasping members are in the second grasping member position.

2. The launching device as in claim 1, wherein the pair of grasping members are pivotally mounted to a hub rotatably secured to the distal end of the arm member.

3. The launching device as in claim 1, wherein the pair of grasping members are spring biased into a first position wherein the pair of grasping members will secure and retain the portion of the action figure within the pair of grasping members.

4. The launching device as in claim 1, wherein one end of the drive shaft is coupled to the pair of grasping members and the other end of the drive shaft is secured to a first gear member configured to engage a second gear member located within the base member.

5. The launching device as in claim 4, wherein movement of the arm member from the first position to the second position causes the first gear to engage the second gear and thus cause rotation of the pair of grasping members.

6. The launching device as in claim 5, wherein the pair of grasping members are configured to release the action figure when the arm member is in the second position.

7. The launching device as in claim 1, wherein the pair of grasping members are spring biased into a first position wherein the pair of grasping members will secure and retain the portion of the action figure within the pair of grasping members when they are in the first position and wherein the pair of grasping members are configured to move to a second position and release the action figure therefrom when the arm member is in the second position.

8. The launching device as in claim 1, wherein the pair of grasping members are parallel to a surface the base member is resting on when the arm member is in the first position.

9. The launching device as in claim 1, wherein the pair of grasping members perpendicular to the direction of travel of the arm member when the arm member is in the second position.

10. The launching device as in claim 1, wherein the arm member is spring biased into the second position, wherein the distal end of the arm member is elevated from the base member when the arm member moves from the first position to the second position and wherein the pair of grasping members are secured to the distal end of the arm member.

11. The launching device as in claim 1, wherein the arm member is pivotally secured to a wall portion of the base member that is pivotally secured to the base member.

12. The launching device as in claim 1, further comprising: an actuation lever pivotally coupled to the base member for movement between a first position and a second position, the actuation lever being operably coupled to the drivetrain such that movement of the actuation lever from the first position to the second position causes the arm member to move from the first position to the second position.

13. The launching device as in claim 11, wherein the pair of grasping members are pivotally mounted to a hub rotatably secured to the distal end of the arm member and wherein the pair of grasping members are spring biased into a first position wherein the pair of grasping members will secure and retain the portion of the action figure within the pair of grasping members.

14. A play set comprising:

at least one action figure;

a launching device for grasping and launching the action figure, the launching device comprising:

a base member;

an arm member pivotally secured to the base member for movement about a pivotal axis between a first position and a second position, the arm member including a first end pivotally secured to the base, a distal end opposite to the first end, and a longitudinal axis extending through the arm member from the first end to the distal end, the longitudinal axis being perpendicular to the pivotal axis;

a pair of grasping members rotatably secured to the arm member proximate the distal end, wherein the pair of grasping members are configured to releasably grasp a portion of the action figure in a first grasping member position;

a drivetrain comprising a driveshaft rotatably received within an interior of the arm member and extending along the longitudinal axis of the arm member, the drivetrain coupled to the pair of grasping members, wherein movement of the arm member from the first position to the second position causes rotational movement of the driveshaft of the drivetrain to rotate the pair of grasping members about the longitudinal axis of the arm member as the arm member moves between the first position and the second position, and wherein the pair of grasping members are moved from the first grasping member position to a second grasping member position when the arm member is moved to the second position from the first position and wherein the pair of grasping members release the portion of the action figure from the pair of grasping members when the pair of grasping members are in the second grasping member position; and a target having a break away portion releasably retained therein, the break away portion being configured to be released from the target upon impact from the action figure.

15. The play set as in claim 14, further comprising: a ring about with the launching device and the target may be placed.

16. The play set as in claim 15, further comprising: a second launching device for grasping and launching a second action figure, the second launching device comprising: a second base member; a second arm member pivotally secured to the second base member for movement between a first position and a second position; a second pair of grasping members rotatably secured to the second arm member, wherein the second pair of grasping members are configured to releasably grasp a portion of the second action figure; and a second drivetrain coupled to the second pair of grasping members wherein the second drivetrain is configured to rotate the second pair of grasping members about a longitudinal axis of the second arm member as the second arm member moves between the first position and the second position.

17. The play set as in claim 15, further comprising: a second launching device for grasping and launching a second action figure, the second launching device comprising: a second base member; a second arm member pivotally secured to the second base member for movement between a first position and a second position; a second pair of grasping members rotatably secured to the second arm member, wherein the second pair of arm members are configured to releasably grasp a portion of the second action figure; and a second drivetrain coupled to the second pair of grasping members wherein the second drivetrain is configured to rotate the second pair of grasping members about a longitudinal axis of the second arm member as the second arm member moves between the first position and the second position, wherein the action figure and the second action figure are launched at each other when the second arm member of the second launching device and the arm member of the launching device are moved to the second position at the same time.

* * * * *